US005467503A

United States Patent [19]

Nolte et al.

[11] Patent Number: 5,467,503

[45] Date of Patent: Nov. 21, 1995

[54] HANDLE AND COVER ASSEMBLY FOR A WINDOW OPERATOR

[75] Inventors: Douglas A. Nolte; Gregory J. Vetter; Kenneth E. Best, all of Owatonna; Dennis J. Krampotich, Burnsville, all of Minn.

[73] Assignee: Truth Hardware Corporation, Owatonna, Minn.

[21] Appl. No.: 370,346

[22] Filed: Jan. 9, 1995

Related U.S. Application Data

[63] Continuation of Ser. No. 278,971, Jul. 20, 1994, abandoned, which is a continuation of Ser. No. 1,270, Jan. 7, 1993, abandoned, which is a continuation-in-part of Ser. No. 882,625, May 13, 1992, Pat. No. D. 347,569.

[51] Int. Cl.[6] ..... E05B 5/02

[52] U.S. Cl. ..... 16/115; 74/557

[58] Field of Search ..... 16/115, 121, 110 R; 74/557, 528, 543, 545

[56] References Cited

U.S. PATENT DOCUMENTS

| | | | |
|---|---|---|---|
| Re. 26,508 | 12/1968 | Stavenau et al. . | |
| 1,799,774 | 4/1931 | Baruh | 74/557 |
| 2,824,735 | 2/1958 | Stavenau et al. . | |
| 2,977,810 | 4/1961 | Stavenau . | |
| 3,032,330 | 5/1962 | Stavenau . | |
| 3,148,913 | 9/1964 | Golde | 74/557 |
| 3,214,157 | 10/1965 | Stavenau . | |
| 3,258,874 | 7/1966 | Martin . | |
| 3,422,575 | 1/1969 | Armstrong . | |
| 3,457,675 | 7/1969 | Armstrong . | |
| 4,083,264 | 4/1978 | Van Klompenburg . | |
| 4,136,578 | 1/1979 | Van Klompenburg . | |
| 4,155,589 | 5/1979 | Kouth | 74/557 |
| 4,253,276 | 3/1981 | Peterson et al. . | |
| 4,266,371 | 5/1981 | Erdman et al. . | |
| 4,305,228 | 12/1981 | Nelson . | |
| 4,346,372 | 8/1982 | Sandberg . | |
| 4,445,794 | 5/1984 | Sandberg . | |
| 4,505,601 | 3/1985 | Sandberg et al. . | |
| 4,617,758 | 10/1986 | Vetter . | |
| 4,823,508 | 4/1989 | Allen . | |
| 4,840,075 | 6/1989 | Tucker . | |
| 4,843,703 | 7/1989 | Nolte et al. . | |
| 4,845,830 | 7/1989 | Nolte et al. . | |
| 4,894,902 | 1/1990 | Tucker . | |
| 4,937,976 | 7/1990 | Tucker et al. . | |
| 4,938,086 | 7/1990 | Nolte et al. . | |
| 5,054,239 | 10/1991 | Tucker et al. . | |
| 5,152,103 | 10/1992 | Tucker et al. . | |

OTHER PUBLICATIONS

Packet of Truth drawings entitled "Prior Truth Handle/Knob Design".

*Primary Examiner*—P. Austin Bradley
*Assistant Examiner*—Chuck Y. Mah
*Attorney, Agent, or Firm*—Wood, Phillips, VanSanten, Clark & Mortimer

[57] ABSTRACT

A cover and folding handle assembly for rotating the drive input member of a window operator to open and close a window, including a handle base drivingly engaging the drive input member and an elongate handle having a first end pivotally connected to the handle base so that the handle is movable between an extended position in which the handle is operable to rotate the drive input member and a folded storage position in which the handle overlies the handle base. An opening in the second end of the handle is aligned with an opening in a knob, and an axial pin has a first end received in one of the aligned openings and a second end received in the other of the aligned openings. A rotatably fixed end of the pin is frictionally secured in one of the openings, and the other pin end is received in a sleeve frictionally secured in the other opening and securing a pin head in that opening. The cover has an opening through which the drive input member on the window operator extends. A retainer is securable to the operator through a first undercut tab engaging a locking groove on the operator. The cover has a groove adjacent to its opening snappingly receiving an undercut end of a second retainer tab extending through the cover opening. The cover also has a slot and the retainer has a tab engaged with the slot for preventing rotation of the cover relative to the operator base.

9 Claims, 3 Drawing Sheets

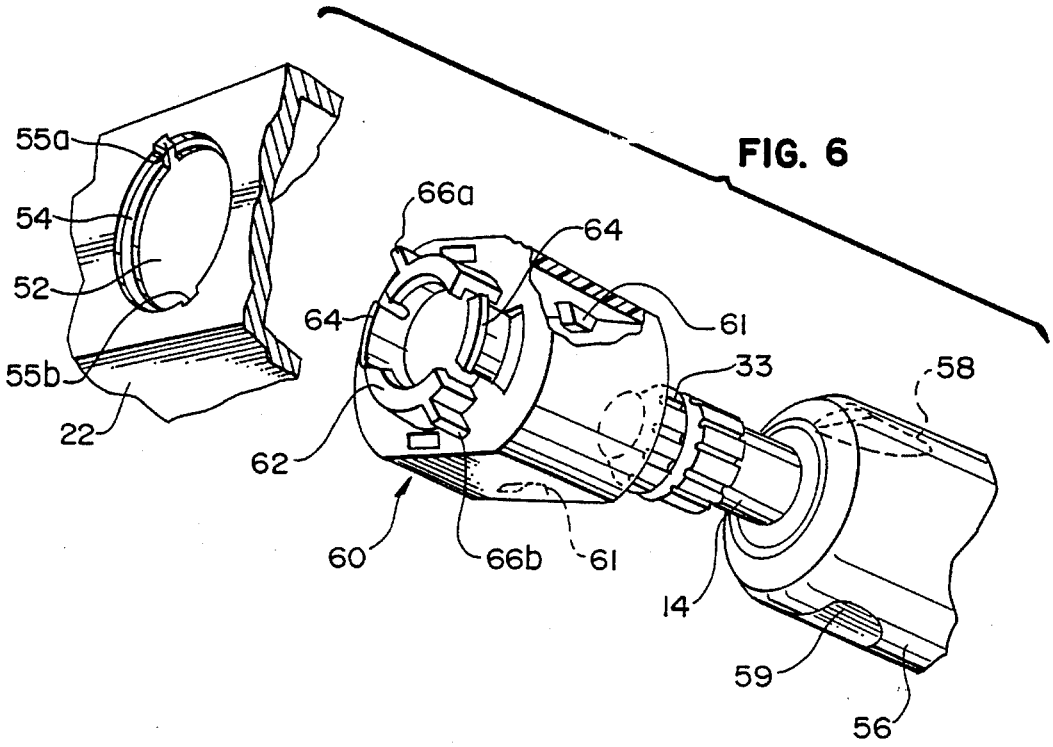
FIG. 6
FIG. 10
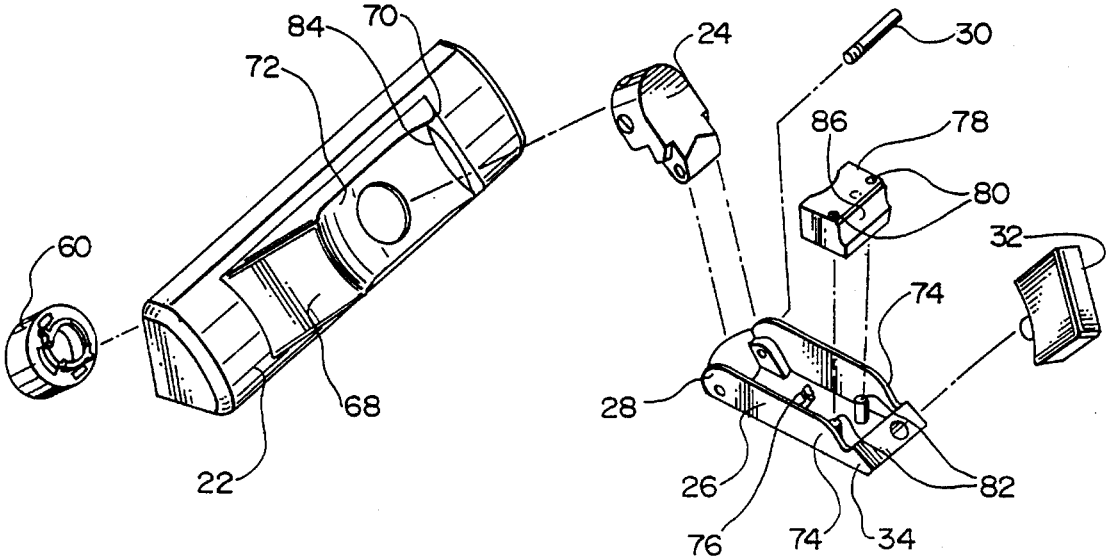

HANDLE AND COVER ASSEMBLY FOR A WINDOW OPERATOR

RELATED APPLICATION

This application is a continuation of U.S. application Ser. No. 08/278,971, filed Jul. 20, 1994, now abandoned, which is a continuation of U.S. application Ser. No. 08/001,270, filed Jan. 7, 1993, now abandoned, which is a continuation-in-part application to U.S. Ser. No. 882,625, filed May 13, 1992, now U.S. Pat. No. Des. 347,569.

BACKGROUND OF THE INVENTION

1. Technical Field

The present invention is directed toward a handle assembly, and more particularly toward a folding handle assembly of a type used in an operator for opening and closing a window.

2. Background Art

Handles for opening and closing pivotally-mounted windows are well known in the art. Window operators typically have an operator base which is mounted on a window frame and a worm gear drive with an associated linkage for engaging the sash of a window. An input drive member transmits a torque for rotating the worm gear drive and actuating the linkage. A handle and housing assembly attach to the drive input member for aesthetic reasons, to protect the operator components, and to permit an individual to manually rotate the drive input member to open and close a window.

It is generally desirable for the components of a handle and housing assembly to be simply yet reliably connected to facilitate assembly and servicing of the operator throughout its useful life. Of course, it is also desirable that such an assembly not only facilitate the installation and service of the operator, but also that the operator allow easy and reliable use of the operator over a long useful life. Still further, it is desirable that such operation be provided by an assembly which is simple and inexpensive to manufacture.

SUMMARY OF THE INVENTION

In one aspect of the invention, a folding handle assembly is provided for rotating the drive input member of a window operator to open and close a window. The folding handle assembly includes a handle base which is drivingly engaged with the drive input member and an elongate handle having a first end and a second end. A hinge connection is provided between the handle base and the first end of the handle so that the handle is movable between an extended position in which the handle is operable to rotate the drive input member and a folded position in which the handle overlies the handle base. The handle assembly has a knob pivotally connected to the second end of the handle so that the knob can be rotated relative to the handle to facilitate application of a torque to the drive input member.

In another aspect of the present invention, the handle base and the drive input member have interengaged splines. A pair of set screws extends through the handle base and engage the drive input member to prevent the handle base from rocking about an axis of one of said set screws.

In another aspect of the invention, an opening in the second end of the handle is aligned with an opening in the knob. An axial pin has a first end received in one of the aligned openings and a second end received in the other of the aligned openings to allow rotation of the knob relative to the handle about the axis of the pin. A rotatably fixed end of the pin is knurled and frictionally secured in one of the openings. The other pin end is received in a sleeve having a knurled surface secured in the other opening and securing the pin head in that opening to allow pivoting of the pin relative to that opening.

In yet another aspect of the invention, the handle assembly has a cover positionable on the base of a window operator. The cover has an opening through which the drive input member on the window operator extends. A retainer is securable to the operator through a first undercut tab engaging a locking groove on the operator. The cover has a groove adjacent to its opening snappingly receiving an undercut end of a second retainer tab extending through the cover opening. In addition, the cover has a slot and the retainer has a tab engaged with the slot for preventing rotation of the cover relative to the operator base.

In another aspect of the invention, the cover has a pair of oppositely sloped sidewalls and a recess between the sidewalls for receiving the second end of the handle when the handle is in the folded position. The first end of the handle is angled with respect to the second end of the handle so that when the second end of the handle is received in the recess, the first handle end overlies and conforms to one of the sloped sidewalls. The handle has a cavity for receiving the handle base and concealing the handle base from view when the handle is in the folded position. A locator member is fixed to the handle and the recess in the cover is adapted to receive the locator member when the handle is in the folded position.

It is an object of the present invention to provide a handle assembly which provides efficient and reliable operation over the long life of the window structure which it operates.

It is another object of the invention to provide a handle and cover assembly which conveniently folds into an aesthetically pleasing configuration wherein a handle conceals a handle base from view and further wherein a knob overlies and conforms to the shape of a cover.

It is another object of the invention to provide a handle assembly which can be folded into a compact arrangement to reduce the likelihood that an exposed handle member will be scratched, bent, or otherwise damaged.

It is yet another object of the invention to provide an assembly which may be inexpensively manufactured, installed and maintained.

It is still another object of the invention to provide an assembly having simple yet reliable connections between the assembly components and the operator to facilitate assembly and maintenance of the operator and assembly throughout the serviceable life of the invention.

BRIEF DESCRIPTION OF THE DRAWINGS

FIG. 6 is an exploded perspective view showing the assembly for securing the cover of the present invention to a window operator;

FIG. 10 is an exploded perspective view of the present invention.

DESCRIPTION OF THE PREFERRED EMBODIMENT

Figure 1:
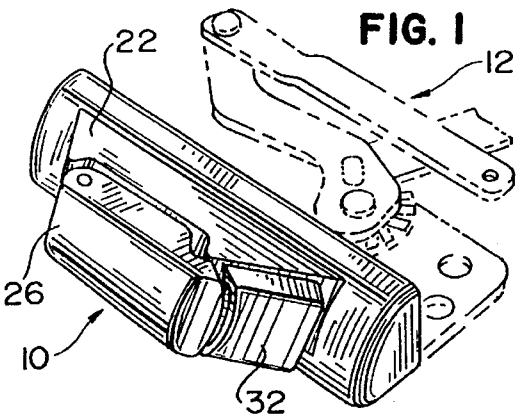
FIG. 1 is a perspective view of the handle assembly of the present invention, shown in a folded position, with an exemplary window operator shown in phantom.
Figure 2:
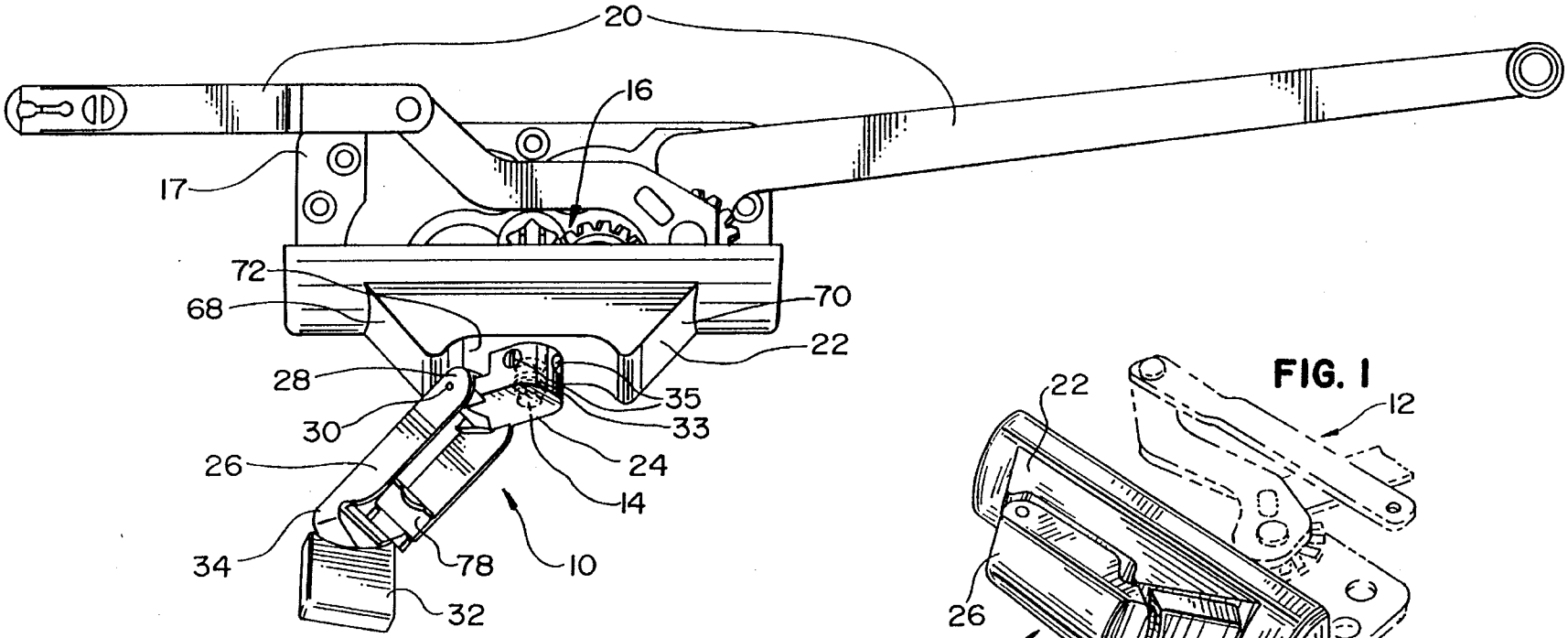
FIG. 2 is a plan view of the FIG. 1 handle assembly in an extended position.

FIGS. 1–2 show the handle and housing assembly (hereinafter referred to simply as "handle assembly") of the present invention in alternative positions and engaged with an operator 12 for opening and closing a window. The window operator 12 has a drive input member 14 engaged with a worm gear drive 16 on a window frame-mountable operator base 17.

The gear drive 16 is intermeshed with a plurality of pivotally interconnected links 20. The links 20 can be attached to a window sash such that rotation of the drive input member 14 is effective to pivot the interconnected links 20 and open and close a window in a suitable manner. Though one type of operator structure is shown for purposes of illustration in FIGS. 1–2, it should be understood that the present invention could be readily adapted for use with virtually any type of window operator.

Specifically, the handle assembly 10 includes a cover or housing 22 secured to the window operator 12 as described in greater detail hereafter. A handle base 24 is drivingly engaged with the drive input member 14. An elongate handle 26 is connected at an end 28 thereof to the handle base 24 to allow manual rotation of the drive input member 14. A hinge pin 30 couples the handle end 28 with the handle base 24 so that the handle 26 is movable relative to the handle base 24 between an extended operating position (FIG. 2) in which the handle 26 is operable to rotate the drive input member 14 and a folded storage position (FIG. 1) in which the handle 26 overlies the handle base 24. A knob 32 is mounted in pivotal relation on an opposite end 34 of the handle 26 so that the knob 32 can be rotated relative to the handle 26 to facilitate operation in which the handle 26 is pivoted about the base 24 to apply torque to the drive input member 14.

An important object of the present invention is the manner in which the above described components of the handle assembly 10 are interconnected as described in detail below.

The handle base 24 and the drive input member 14 have complementary interengaged splines 33 for transmitting torque between the handle 26 and the drive input member 14. A pair of set screws 35 are spaced approximately ninety degrees from each other and extend through the handle base 24 and engage the drive input member 14. The use of two set screws prevents the handle base 24 from rocking relative to the cover 22.

Figure 3:
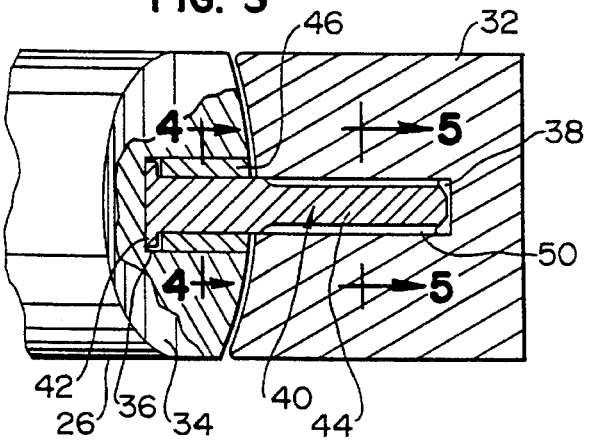
FIG. 3 is an enlarged sectional view showing the connection between the handle and the knob of the present invention.
Figure 4:
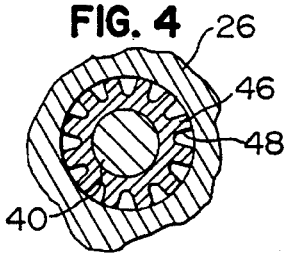
FIG. 4 is a cross-sectional view taken along line 4—4 of FIG. 3.
Figure 5:
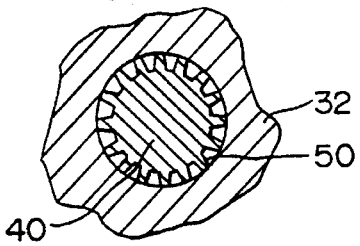
FIG. 5 is a cross-sectional view taken along line 5—5 of FIG. 3.
Figure 8:
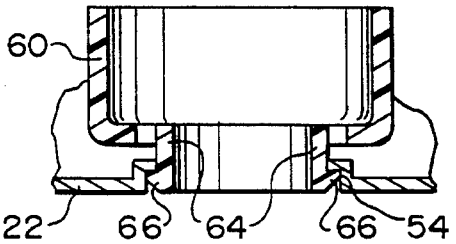
FIG. 8 is a cross-sectional view taken along line 8—8 of FIG. 7.
Figure 7:
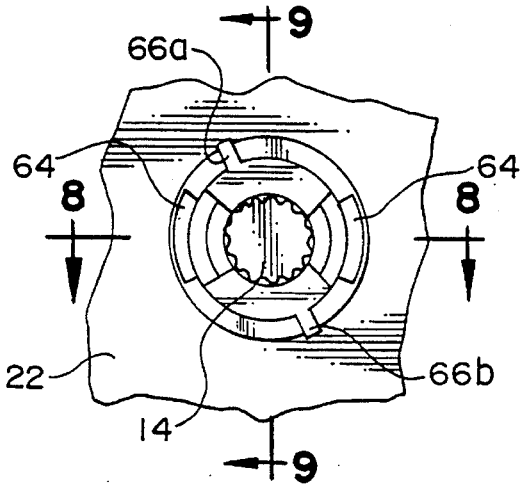
FIG. 7 is a partial plan view of the assembly of FIG. 6.
Figure 9:
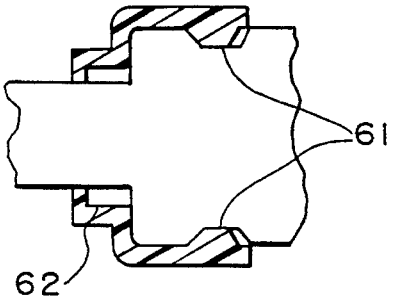
FIG. 9 is a cross-sectional view taken along line 9—9 of FIG. 7.

As shown in FIGS. 3–5, the end 34 of the handle 26 has a generally cylindrical opening 36. The knob 32 has a generally cylindrical opening 38 substantially aligned with the opening 36 in the handle 26. An axial pin 40 has a headed end 42 received in the opening 36 and a shank 44 received in the opening 38 to maintain alignment of the handle 26 with the knob 32. The pin 40 extends through a sleeve 46 positioned in the opening 36. The sleeve 46 preferably is stainless steel and has a knurled exterior surface 48 in frictional press fit engagement with the inner wall of the opening 36 whereby the sleeve 46 acts as a bearing and permits rotation of the pin 40 about its axis relative to the handle 26. The shank 44 of the axial pin 40 has an integral knurled surface 50 in frictional press fit engagement with the inner wall of the opening 38 to fix the pin 40 to the knob 32.

The above construction of the handle 26 and the knob 32 (i.e., the press fit interconnection of the handle and the knob) provides a structure which is easily assembled and readily serviceable. In addition, it should be recognized that the advantages of this aspect of the present invention can alternatively be achieved by positioning the headed end 42 of the axial pin 40 and the sleeve 46 in the opening 38 on the knob 32 and by positioning the knurled shank 44 of the pin 40 in the opening 36 on the handle 26.

Structure for releasably securing the cover 22 to the window operator 12 is shown in FIGS. 6–9.

Specifically, the cover 22 has a circular opening 52 through which the spline 33 on the drive input member 14 extends. A countersunk groove 54 extends around the peripheral edge of the opening 52 and a pair of diametrically opposed slots **55*a* and 55*b* extend radially from the opening 52. A tubular boss 56 on the operator base 17 supports the drive input member 14 and has a pair of locking grooves 58 and 59. A retainer clip 60 releasably secures the cover 22 to the tubular boss 56** in the manner described herebelow.

The retainer clip 60 preferably is made of plastic and has a neck 62 which extends axially through the opening 52 on the cover 22. The drive input member 14 extends coaxially through the neck 62 and the opening 52 in the cover 22 and engages the handle base 24. A pair of undercut tabs 61 on the inside of the retainer clip 60 snap into a corresponding one of the locking grooves 58 and 59 on the boss 56 to releasably secure the retainer clip 60 to the operator base 17.

A pair of diametrically opposed resilient tabs 64 are struck from the retainer clip neck 62. Each tab 64 has an undercut end 66 for snappingly engaging the groove 54 when the neck 62 is inserted into the cover opening 52 (see FIG. 8). A pair of radial tabs **66*a* and 66*b* on the neck 62 engage the slots 55*a* and 55*b*, respectively, and prevent the cover 22 from rotating relative to the boss 56**.

In a preferred embodiment of the present invention, the clip tabs 61 will be such that the clip 60 will release the boss 56 before the clip tabs 64 release the cover 22. However, as an alternative embodiment, the cover 22 may be configured with an inner surface enclosing the clip 60 at the tabs 61 when assembled. In this manner, the clip 60 may first be assembled onto the boss 56 with the clip 60 flexing slightly outwardly to allow the tabs 61 to snap into position. Then, when the cover is mounted over the clip 60 (as described below), the cover 22 will prevent the clip 60 from thereafter flexing outwardly and thereby prevent the clip tabs 61 from undesirably disengaging from the locking grooves 58, 59 while assembled.

Of course, it is also desirable to match the cover 22 and the operator base 17 in such a manner that the outer perimeter of the cover 22 is secured to the base 17 by the above described assembly in such a manner that cover 22 is secured against twisting relative to the base 17.

Further, the retainer clip neck 62 is preferably matched to the input member 14 by an interference fit and is attached to the handle base 24 as previously described. As a result of this arrangement, location tolerances between the cover 22 and the handle base 24 are kept to a minimum. This is particularly desirable with handle structures like that shown where aesthetics and function require that the handle properly nest in the cover 22 when closed.

Referring next to FIG. 10, and also with reference to FIGS. 1 and 2, the cover 22 has a pair of oppositely sloped sidewalls 68 and 70 and a recess 72 interposed between the sidewalls 68 and 70 for receiving the handle 26 when the handle 26 is in the folded position.

The handle 26 has a pair of spaced apart sidewalls 74 which define a cavity 76 on the underside of the handle 26 for concealing the handle base 24 from view when the handle 26 overlies the cover 22 in the folded position. In addition, one end 34 of the handle 26 is angled with respect to the other handle end 28 so that the knob 32 and the handle end 34 overlie and conform to the sloped sidewall 70 when the end 28 of the handle 26 is received in the recess 72.

In order to properly align the handle 26 with the recess 72 when the handle 26 is moved to the folded position, a locator member or block 78 is positioned in the cavity 76 and is attached to the underside of the handle 26. The locator block 78 has a pair of spaced apart openings 80 suitably secured to corresponding alignment pegs 82 on the handle 26 (by, for example, an adhesive bonding or a friction fit) to maintain a preferred position of the locator block 78 on the handle 26. The recess 72 on the cover 22 has a notched end wall 84 which is adapted for positive engagement with a complementary surface 86 on the locator member 78. Engagement between the locator member 78 and the notched wall 84 holds the folded handle 26 in a centered position on the cover 22 and prevents the folded handle from being shifted laterally and rotating the drive input member 14.

Further, the handle 26 could be secured in either its extended or folded position, if desired, by suitable means such frictional engagement, detent structures or the like.

As will be understood by those who have gained an understanding of the present invention from the disclosure herein, the above described handle assembly 10 provides efficient and reliable operation over the long life of the window with which it is used. This handle assembly 10 conveniently folds into an aesthetically pleasing configuration wherein the handle 26 conceals the handle base 24 from view and the knob 32 overlies and conforms to the shape of the cover 22. Moreover, the compact arrangement of the folded handle assembly reduces the likelihood that an exposed handle member will be scratched, bent, or otherwise damaged. The simple yet reliable connections between the handle assembly components facilitates assembly and maintenance throughout the serviceable life of the invention. The simplicity of this invention contributes to ease and low cost of manufacture.

Still other aspects, objects, and advantages of the present invention can be obtained from a study of the specification, the drawings, and the appended claims.

We claim:

1. A pivotable knob and handle assembly for a window operator, comprising:

a handle having an opening in one end;

a knob having an opening in one end; said knob opening being axially aligned with said handle opening;

an axial pin having a head on one end and a friction surface about the other end;

a sleeve disposed over said axial pin and having a friction surface about its outer periphery, said sleeve having an inner diameter greater than the outer diameter of the pin other end;

wherein said pin other end is frictionally press fit in either the handle end opening or the knob opening and said sleeve is frictionally press fit in the other of the openings whereby said sleeve secures said pin against axial movement while permitting rotational movement of the pin relative to the sleeve.

2. The assembly of claim 1, wherein said handle opening is a recess in said handle having a bottom, and said sleeve is frictionally press fit in the handle opening with the pin head disposed between the sleeve and the handle opening bottom.

3. The assembly of claim 1, wherein said handle opening and said knob opening are each recesses having a bottom, and said pin head is disposed between said sleeve and the bottom of said other of the openings.

4. A pivotable knob and handle assembly for a window operator, comprising:

a handle having an opening in one end;

a knob having an opening in one end;

a pin having a head on one end and a friction surface about the other end;

a sleeve disposed over said pin and having a friction surface about its outer periphery, said sleeve having an inner diameter greater than the outer diameter of the pin other end;

wherein said pin other end is frictionally press fit in either the handle end opening or the knob opening and said sleeve is frictionally press fit in the other of the openings whereby said sleeve secures said pin against axial movement while permitting rotational movement of the pin relative to the sleeve.

5. The assembly of claim 4, wherein said handle opening is a recess in said handle having a bottom, and said sleeve is frictionally press fit in the handle opening with the pin head disposed between the sleeve and the handle opening bottom.

6. The assembly of claim 4, wherein said handle opening and said knob opening are each recesses having a bottom, and said pin head is disposed between said sleeve and the bottom of said other of the openings.

7. A pivotable knob and handle assembly for a window operator, comprising:

a handle having an axially extending cylindrical wall defining an axial opening in one end;

a knob having an axially extending cylindrical wall defining an axial opening in one end;

an axial pin having a head on one end and axially extending friction surfaces about the other end;

a sleeve disposed over said pin and having an axially extending friction surface about its outer periphery, said sleeve having an inner diameter greater than the outer diameter of the pin other end;

wherein said pin other end is secured in either the handle end opening or the knob opening by frictional engagement of the pin axially extending friction surface with either the handle or knob axially extending cylindrical wall, and said sleeve is frictionally secured in the other of the openings by frictional engagement of the sleeve axially extending friction surface with the other of the knob or handle axially extending cylindrical walls;

whereby said sleeve secures said pin against axial movement while permitting rotational movement of the pin relative to the sleeve.

8. The assembly of claim 7, wherein said handle opening is a recess in said handle having a bottom, and said sleeve is frictionally press fit in the handle opening with the pin head disposed between the sleeve and the handle opening bottom.

9. The assembly of claim 7, wherein said handle opening and said knob opening are each recesses having a bottom, and said pin head is disposed between said sleeve and the bottom of said other of the openings.

* * * * *